United States Patent [19]

Person et al.

[11] 4,130,077

[45] Dec. 19, 1978

[54] SINGLE-POINT MOORING SYSTEM

[75] Inventors: Abraham Person, Los Alamitos; Yilmaz H. Ozudogru, Rancho Santa Fe, both of Calif.

[73] Assignee: Global Marine, Inc., Los Angeles, Calif.

[21] Appl. No.: 836,068

[22] Filed: Sep. 23, 1977

[51] Int. Cl.[2] ..... B63B 21/00

[52] U.S. Cl. ..... 114/230; 9/8 P

[58] Field of Search ..... 166/0.5; 175/7; 9/8 R, 9/8 P; 114/230, 267, 210, 256, 257; 61/48

[56] References Cited

U.S. PATENT DOCUMENTS

| | | | |
|---|---|---|---|
| 3,195,639 | 7/1965 | Pollard | 166/0.5 |
| 3,481,294 | 12/1969 | Vincent | 9/8 P |
| 3,522,787 | 8/1970 | Tam | 114/230 |

*Primary Examiner*—Trygve M. Blix
*Assistant Examiner*—D. W. Keen
*Attorney, Agent, or Firm*—Christie, Parker & Hale

[57] ABSTRACT

A single-point mooring system is provided for substantially permanently mooring a floating structure, such as an offshore natural gas treatment facility located on a shipform hull, to an anchor point. A rigid anchor structure, fixed to the bottom of the water body, defines a vertically oriented circular cylinder above the water surface. A collar is mounted circumferentially of the cylinder for movement about and along the cylinder. A pair of rigid arms extend from the floating structure in spaced relation to either side of the cylinder and are spaced equally from the roll axis of the floating structure. Resilient connections are coupled between the arms, the floating structure and the collar to locate the collar centrally between the arms in a normal state, to afford and to accommodate motions of the floating structure relative to the collar in horizontal directions and also about the roll axis of the floating structure in surge, sway and roll, and to absorb the forces manifested between the floating structure and the collar in association with surge and sway motion of the floating structure. Pitch, heave and heading change motions of the floating structure are accommodated by motion of the collar relative to the cylinder.

28 Claims, 10 Drawing Figures

SINGLE-POINT MOORING SYSTEM

BACKGROUND OF THE INVENTION

1. Field of the Invention

This invention pertains to mooring systems for ships and other floating structures. More particularly, it pertains to an essentially permanent single-point mooring system for use with floating structures intended to be moored in a given location for long periods, say several years.

2. Review of the Prior Art

Increasing attention is being given to marine transportation of liquefied natural gas (LNG), in addition to petroleum, to meeting increasing and increasingly critical energy requirements worldwide. Several vessels for ocean transport of LNG have already been built, and more are now under construction or in stages of planning. As LNG liquefaction and gasification facilities now exist only at land-based locations, it will be necessary for these LNG tanker ships to load and unload cargo at existing ports. These facilities are usually located in the ports themselves, often some distance from the natural gas source which may be at an offshore location.

Ocean ports usually develop into substantial centers of population. It is known that, even with the practice of stringent safety precautions, LNG liquefaction and gasification facilities present hazard, more or less, to adjacent structures and populations in the event of an accident. It is therefore desirable, subject to compatibility with marine transport cargo transfer requirements, to locate LNG liquefaction and gasification facilities remote from existing population centers; this is possible only with new ocean ports, if they can be developed, and only until such time as the new ports themselves become population centers.

In many areas, the principal sources of natural gas are in offshore gas fields, such as in Indonesia and the Persian Gulf, for example. To supply LNG from these areas, it is presently necessary to pipe the gas from the offshore fields to onshore gas liquefaction plants from which the LNG is transported to the LNG tanker ships.

To minimize the hazards of LNG treatment facilities to adjacent population centers, and to reduce the cost of producing LNG, it has been proposed to locate LNG liquefaction facilities at offshore locations, particularly in or close to offshore gas fields. It has also been proposed to locate LNG gasification facilities at offshore locations safely spaced from, but otherwise reasonably close to centers of gas consumption or to connection to gas transport pipelines. Such facilities have been proposed in the context of permanent structures erected on the ocean floor, and in the context of floating factory ship vessels.

The disadvantage of permanent structures erected on the ocean floor is that they usually are contemplated remote from major manufacturing centers which means that they are very costly to construct, and that they require considerable time to construct which means that they are subject to delay and damage in construction because of storms, high seas and the like. The advantage of such LNG treatment facilities on floating structures is that the structures, such as factory ships, can be built efficiently and economically in existing centers of commerce, such as shipyards, and towed or self-propelled to their intended location of use. The difficulty, at least to date, with floating LNG treatment facilities has been in the area of mooring the facility in place for long periods in such a way as to enable the floating structure to conform to, rather than fight against the variable forces of wind and wave action. Another difficulty has been that of supplying gas to or from a floating LNG factory ship with safety over a long period.

Various approaches to offshore mooring of ships have been proposed. The proposals pertinent to mooring of tankers at offshore locations while taking on and offloading cargo (petroleum or petroleum distillates) are not adaptable directly to LNG factory ships; these proposals pertain to short-term mooring of the vessel, not to a mooring which may exist for several years. Other proposals pertinent to long-term mooring arrangements have been made in the context of factory ships or other vessels moored in harbors or other protected waters where the moored vessel is not exposed to the full effects of wind and wave action which may come from any compass direction. These latter proposals, therefore, are not directly adaptable to long-term mooring of vessels at fixed locations in places significantly offshore, as in the open ocean.

For example, a proposal has been made for a permanent mooring for an offshore processing and storage facility. In this proposal, the mooring is totally resilient. The mooring and the oil supply line it supports flex and move in response to mooring loads. In this proposal, there are flexible oil line elements (hoses and swivels) and mechanical oil line elements (valves and other closures, for example) below the water which require maintenance and/or periodic replacement. To facilitate maintenance and replacement of these elements, the oil lines are redundant. Perhaps most significant is the fact that the oil pressure may be in the range of 100 to 200 psig, whereas natural gas line pressure may be in the range of from 600 to 1200 psig. As compared to natural gas, the lower oil pressure encountered in this proposal has two effects. The considerably lower oil supply line pressure produces much lower stresses in the supply piping. The lower pressure and the higher viscosity of oil means that initial leaks will be small and can be dealt with before becoming catastrophic. Oil, if light enough, will float on the water surface in such manner to make difficult ignition of the oil. Natural gas leaking from submerged supply lines will expand in volume as it rises to the water surface, and will rise above the water surface where it can be ignited very easily. Thus, natural gas provides an entirely different problem from oil. The moorings useful with offshore oil treatment and transfer facilities can be used with natural gas only with considerable difficulty and hazard.

A need is thus seen to exist for a system for safely mooring floating vessels at open-ocean offshore locations for very long periods, in the order of several years. Such a system, to be well suited to safe supply of gas to and from the vessel where the vessel is an LNG factory ship, should include a single mooring point which is essentially fixed relative to the ocean floor. The mooring system should impose minimum constraints on the vessel relative to the mooring point so that the vessel can move to the greatest extent possible in response to wind and wave action, to thereby minimize the loads imposed on the vessel and the mooring by wind and wave action. On the other hand, the mooring system must be able to withstand and preferably absorb those loads, and the motions related to such loads, which are necessary to keep the vessel connected to the mooring point. Ideally, the mooring system should be relatively quickly connected in the first instance, and it should be arranged so that in an emergency the coupling between the vessel and the mooring point can be severed to enable the vessel to be moved away from the connection point.

SUMMARY OF THE INVENTION

This invention provides a long-term mooring arrangement which is believed to be effective to satisfy the need described above. The mooring provides a connection between a ship or other floating structure and a single mooring point, which connection can be maintained for long periods, in the order of several years. The mooring point is essentially fixed relative to the ocean floor and thus provides a mechanism by which a natural gas pipeline can be connected to the ship without stress of the pipeline below the mooring point. The mooring allows the ship to move about the mooring point in response to wind, wave, current and tidal action in roll, pitch, heave and heading change modes of motion; in effect, the ship can "weathervane" relative to the mooring point in such motion modes. On the other hand, the forces associated with surge and sway motions of the ship are accommodated and absorbed in the mooring. The ship and the mooring, therefore, are maximally compliant to the various natural forces imposed upon them while still being effective to keep the ship coupled to the mooring point.

Also, the mooring arrangement is devised so that a major portion of its structure can be installed prior to arrival of the ship at the mooring site. Once the ship arrives, it can be permanently coupled to the fixed mooring point relatively quickly with minimal reliance on auxiliary vessels to make the connection. The mooring, once established, is permanent in that it is intended to be maintained for long periods, say several years, without disconnection of the ship from the mooring point save for emergency situations. In an emergency, the coupling of the ship to the mooring point can be severed very quickly and the ship can be moved immediately away from the mooring point. The ship is not held captive to the mooring point as in certain other single-point long-term mooring arrangements which have been proposed.

Generally speaking, this invention provides an apparatus for mooring a structure floating in a body of water to an anchor point located above the water surface. The mooring apparatus comprises a substantially rigid anchor structure adapted to be fixed to the bottom of the body of water and to extend above the water surface where it defines a right circular cylinder. The cylinder has a vertically disposed axis. A portion of the structure above the water surface comprises the anchor point. A collar is mounted to the cylinder circumferentially thereof and moves both angularly about and axially along the cylinder. A pair of rigid supports extend above the water surface from the floating structure. The supports are spaced substantially equally from and on opposite sides of a roll axis of the floating structure. The spacing between the supports is greater than the diameter of the collar. Resilient connections are made between the supports and the collar. The connections serve to locate the collar centrally between the supports in a normal state of a mooring apparatus. The resilient connections also serve to afford and accommodate motion of the floating structure, as manifested at the supports, relative to the collar in horizontal linear directions and angularly about the roll axis of the floating structure in surge, sway and roll. The resilient connections further serve to absorb forces manifested between the collar and the floating structure in association with the surge and sway motions of the floating structure. The collar moves on the anchor structure cylinder in response to pitch, heave and heading change motions of the floating structure relative to the anchor point.

DESCRIPTION OF THE DRAWINGS

The above-mentioned and other features of this invention are more fully set forth in the following detailed description of the presently preferred and other embodiments of the invention, which description is presented with reference to the accompanying drawings, wherein.

DESCRIPTION OF THE ILLUSTRATED EMBODIMENTS

Figure 1:
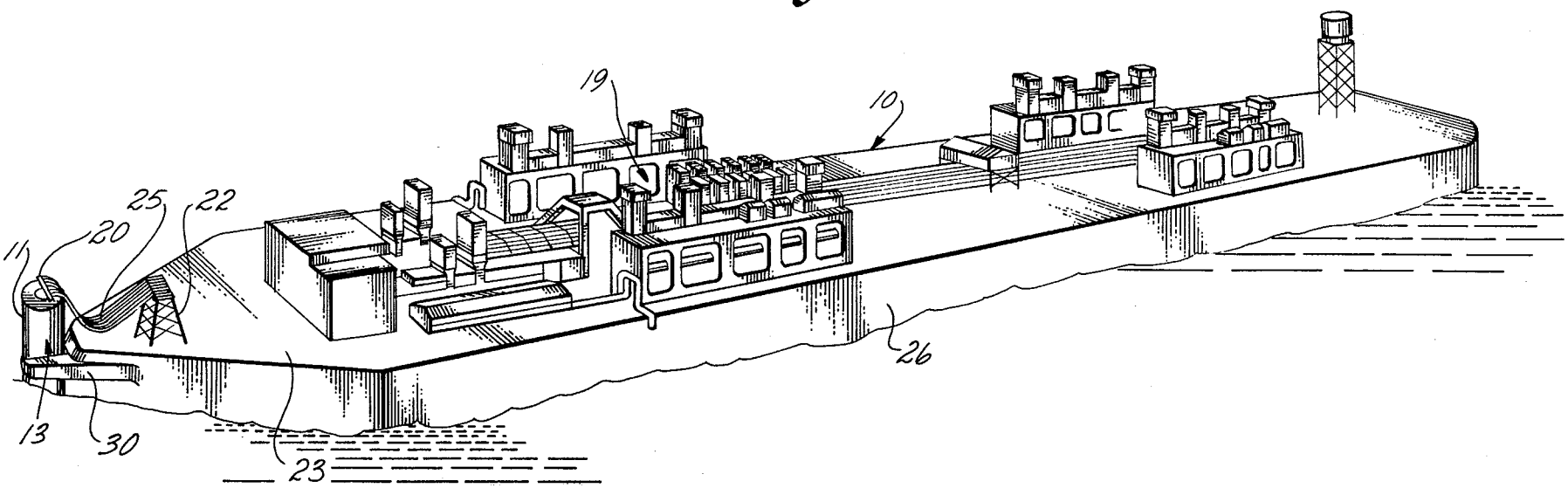
FIG. 1 is a perspective view of an LNG factory ship moored to a fixed anchor point by a mooring arrangement according to this invention.
Figure 2:
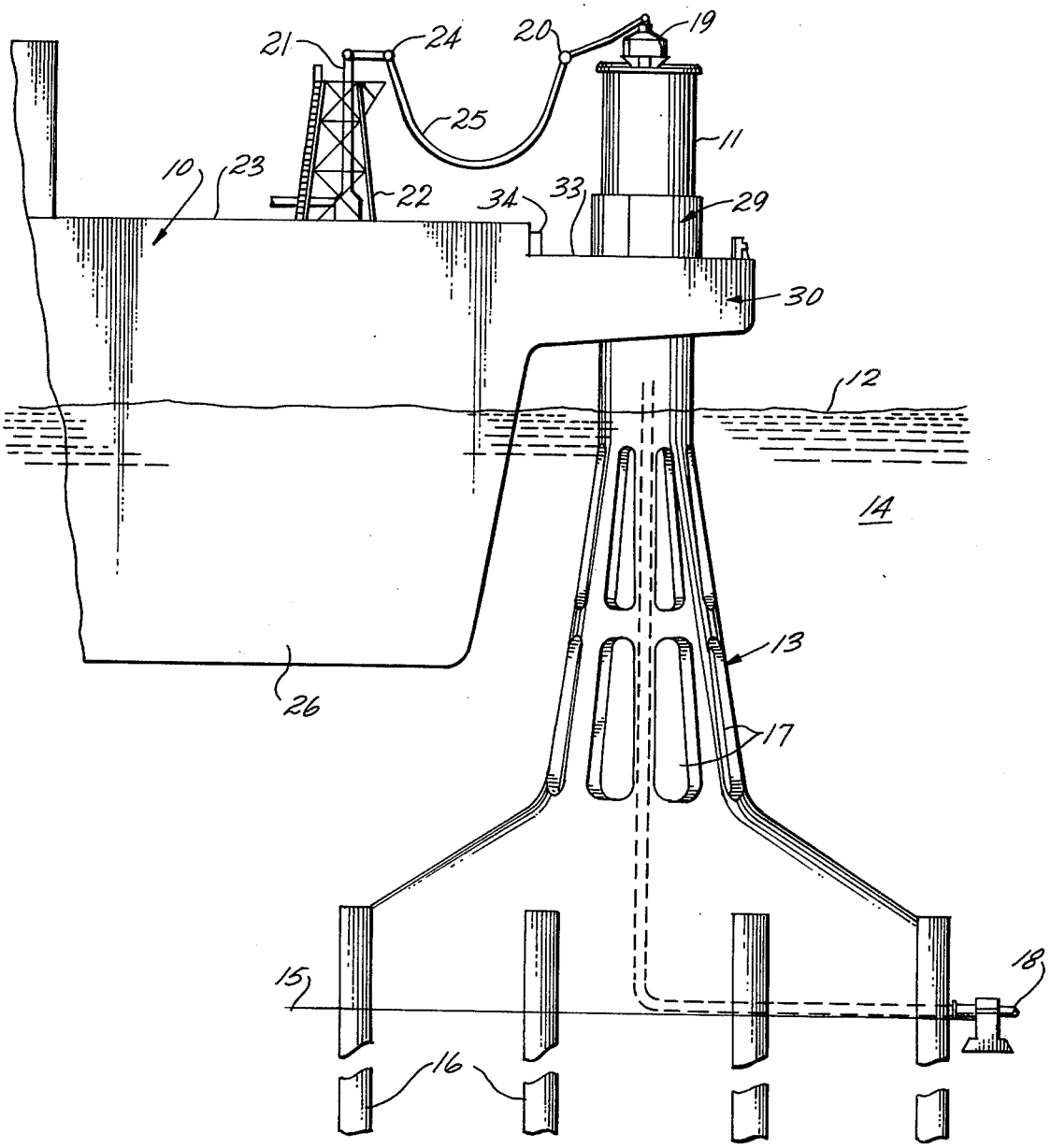
FIG. 2 is a fragmentary elevation view of the anchor structure which defines the mooring point, and of the forward end of the factory ship shown in FIG. 1.

A floating LNG factory ship 10 is shown in FIGS. 1 and 2 moored to a vertically extending cylindrical pylon 11 defined above water surface 12 by an anchor structure 13 which is secured to the bottom of water body 14, such as to ocean floor 15. Anchor structure 13 is particularly suited to use where water body 14 is relatively shallow between water surface 12 and floor 15, say on the order of 150 to 200 feet deep. The anchor structure is essentially rigid and is securely connected to the ocean floor as by pilings 16 coupled between the bottom of the anchor structure and the geological formation which underlies the ocean floor. Preferably, anchor structure 13 is fabricated of reinforced concrete and is a massive structure. To minimize the loads imposed upon the anchor structure by wave action and the like, a plurality of apertures 17 are formed through the anchor structure in the portion thereof immediately below water surface 12 over that height of the anchor structure which is likely to be subjected to the dynamic effects of wave action and drag forces due to currents. A natural gas transport pipeline 18 extends across ocean floor 15 to the anchor structure from an appropriate remote location which can be a source of natural gas, in which case the LNG factory ship 10 defines a natural gas liquefaction facility 19 as shown in FIG. 1. Where the LNG factory ship carries facilities for gasification of LNG, transport pipeline 18 extends from anchor structure 13 to an on shore gas pipeline, for example.

It will be appreciated that the specific nature of the facility carried by ship 10 is not material to this invention. An LNG liquefaction facility 19 is illustrated in FIG. 1 solely for the purposes of example to set forth a presently preferred utility of this invention. In the context of an LNG liquefaction or gasification factory ship, however, FIG. 2 illustrates a significant aspect of this invention, namely, that transport pipeline 18 (containing natural gas which may be under high pressure), as it extends into and upwardly through anchor structure 13, is isolated by the support structure from any loads which might otherwise be imposed upon it by the ship as it moves relative to the support structure in response to wind, wave, current and tidal action, for example. Accordingly, within the support structure, pipeline 18 is free of any loads which would cause the pipeline to flex or bend cyclically in response to similar cyclic motions of ship 10. Cyclic loads imposed upon the pipeline tend to weaken it and thus increase the hazard of a failure of the pipeline. In the context of a relatively shallow water mooring as shown in FIG. 2, this isolation of transport pipeline 18 from cyclic loads and the like is an important feature of the anchor structure and is the principal reason why the anchor structure is itself both massive and rigid, thereby to locate pylon 11 in essentially fixed relation to ocean floor 15.

At its extreme upper end, pipeline 18 is connected to a swivel assembly 19 by which the pipeline is connected to a header manifold 20. A gas transport pipeline 21 is carried by that portion of ship 10 which lies adjacent to pylon 11. Pipeline 21 extends, for example, upwardly through a tower 22 on the forward portion of the ship main deck 23 to a header 24. Headers 20 and 24 are interconnected by a plurality of flexible gas transport conduits 25.

The upper portion of the pylon, at least above the water surface, is of right circularly cylindrical configuration about a vertical axis. The pylon defines the anchor point to which ship 10 is essentially permanently connected by a mooring arrangement according to this invention.

As noted above, a presently preferred utility of this invention is in connection with a natural gas liquefaction factory ship which is moored for an extended period, say several years, to anchor structure 13. Factory ship 10 is of substantial size and may have, for example, an overall length of 860 feet, a beam of 192 feet, a depth of 94 feet, a draft of 54 feet, and a displacement at design draft of approximately 240,000 long tons. It is presently preferred that the hull of ship 10 be fabricated of reinforced concrete rather than of steel because of the superior corrosion resistance characteristics of concrete, among other reasons. As shown in FIGS. 1 and 2, ship 10 has a hull 26 which is generally of shipform configuration. Hull 26 may have a very high prismatic coefficient since the ship is not intended to be self-propelled or moved from place to place during essentially the entirety of its useful life; it preferably is towed into position from its originating shipyard, for example.

Figure 3:
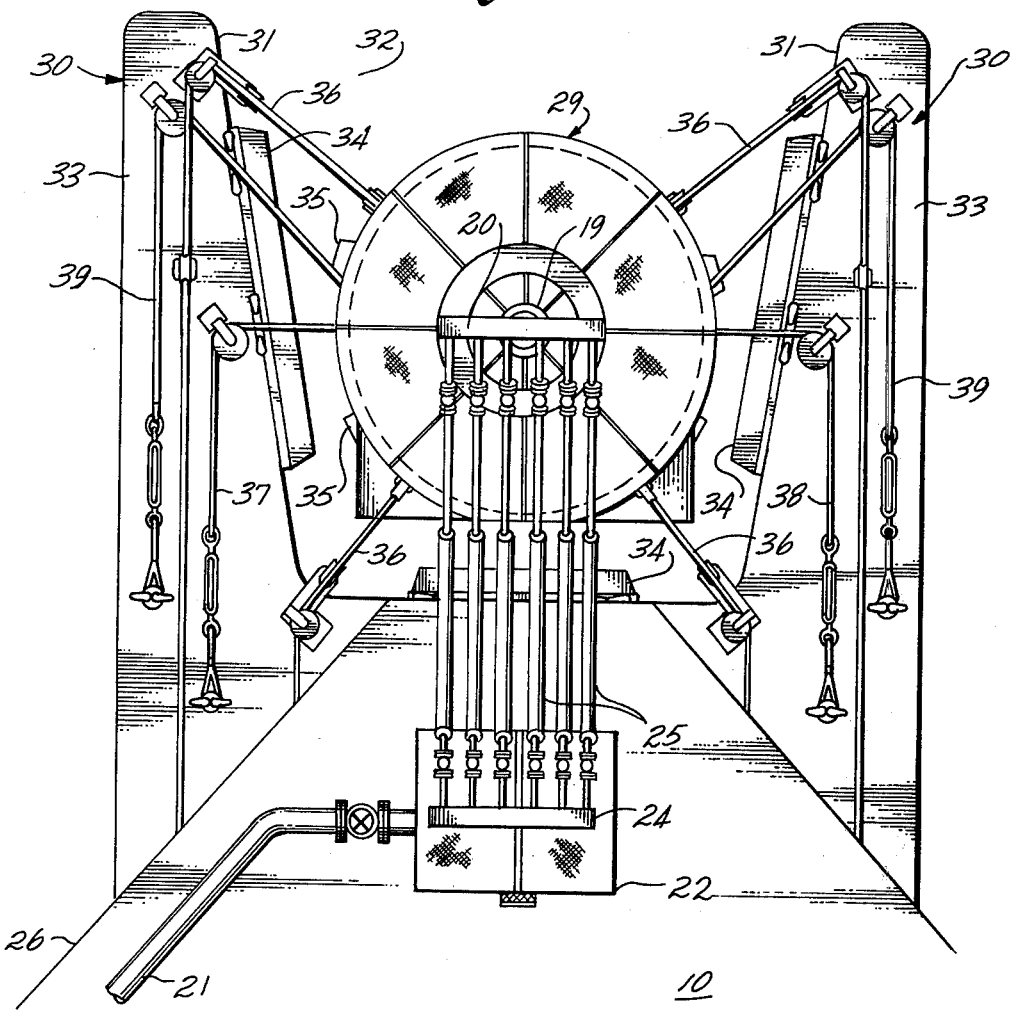
FIG. 3 is a simplified top plan view of the structure shown in FIG. 2.
Figure 4:
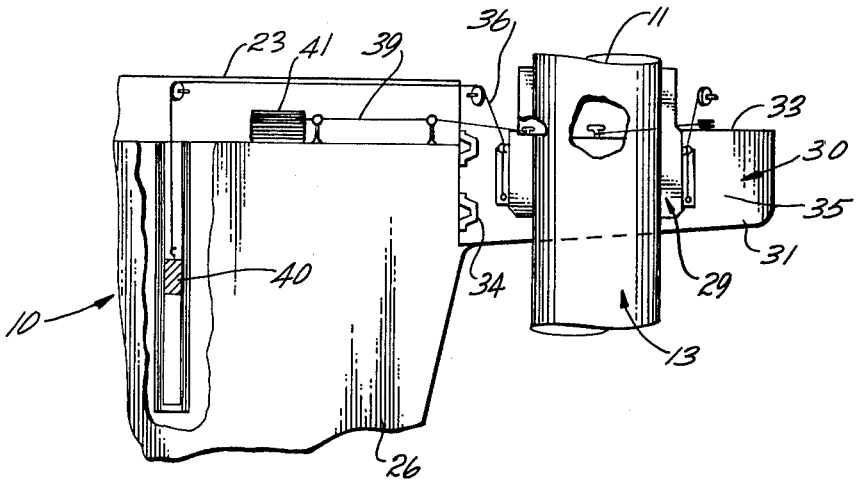
FIG. 4 is a fragmentary cross-sectional elevation view of a portion of the mooring arrangement shown in FIG. 3.

As shown in FIGS. 2 and 4, for example, a collar 29 is disposed circumferentially about the cylindrical exterior surface of pylon 11. The interior of the collar cooperates with the pylon by suitable bearings (not shown) so that the collar is both rotatable about and axially movable along the pylon. The collar, in the assembled mooring arrangement, is disposed in spaced relation to, and substantially centrally between a pair of support arms 30 which extend above water surface 12 from hull 26. Arms 30 are rigid and they are rigidly connected to the hull. As shown in FIG. 3, for example, the opposing faces 31 of the arms, together with the forward portions of hull 26, define a recess 32 which opens away from the bow of the hull and which preferably is of progressively greater width proceeding away from the hull. As shown in FIGS. 1 and 4, for example, the arms have upper surfaces 33 which preferably are disposed below hull main deck 23. Fenders 34 are secured to the substantially vertical opposing faces 31 of the arms and to the substantially vertical stem surface of hull 26 in recess 32 to protect the hull, the arms and the collar from damage in the unlikely event that the ship experiences loads which are incapable of being absorbed by the mooring arrangement. Fenders 35 are also mounted to the exterior of collar 29.

In a mooring system according to this invention, a plurality of resilient connections are established between the ship hull (which includes arms 30) and collar 29 for locating the collar centrally between the support arms in a normal state of the mooring, for affording and accommodating motions of the ship as manifested at support arms 30 relative to the collar in horizontal linear directions, and also angularly about the roll axis of the ship in surge, sway and roll, and further for absorbing the forces which are manifested between the collar and the ship in association with surge and sway motions of the ship relative to pylon 11. In order that resilient connections of the mooring system may serve this purpose, support arms 30 are located equidistantly from and on opposite sides of the longitudinal centerline of hull 26. The support arms are therefore located on opposite sides of and equidistantly from the roll axis of hull 26.

Resilient connections of the character described above are illustrated generally in FIG. 3, which is a top plan view of an idealized, not actual, mooring arrangement according to this invention. These resilient connections are shown in FIG. 3 to be defined by a plurality of lines which may be either hawsers, wire rope cables, chain or other structures which, by virtue of either their inherent nature or their connection between the collar and the hull, can effectively be represented as springs in a mechanical analogy of the mooring arrangement. Thus, in the idealized representation shown in FIG. 3, the resilient connections include collar support lines 36, port and starboard sway compensation lines 37 and 38, respectively, and forward surge compensation lines 39. Collar support lines 36 are connected to the collar at locations about the collar selected and defined appropriately for support of the collar on pylon 11 from support arms 30, and may extend from the collar via suitable sheaves and fairleads to constant tension biasing mechanisms on board the ship, such as counterweights 40 shown in FIG. 4. The surge and sway compensation lines 37, 38 and 39 may extend from the collar to fixed connection points on the support arms or elsewhere on the ship as shown in FIG. 3, or to constant tension winches 41 as shown in FIG. 4.

Figure 5:
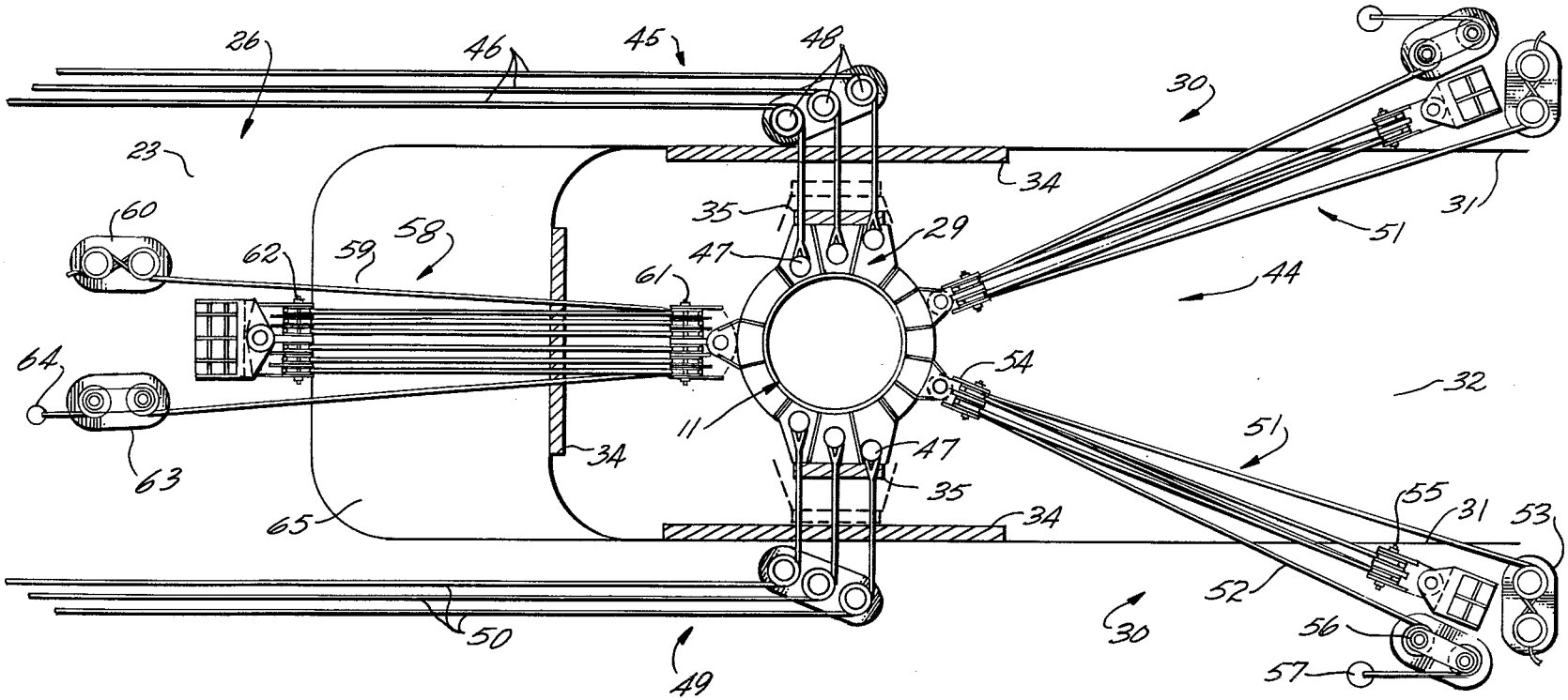
FIG. 5 is a fragmentary and simplified plan view of the presently preferred resilient connections between the ship and the anchor structure.

A presently preferred mooring arrangement 44 is shown in FIG. 5. Mooring arrangement 44 includes separate port sway, starboard sway, forward surge and aft surge resilient connections between hull 26 and collar 29, which resilient connections also serve as the connections for supporting collar 29 axially along pylon 11. A port sway compensation connection 45 is composed of three hawsers 46 which are connected at one end to suitable rope anchors 47 carried by collar 29 at a location adjacent to the port one of support arms 30. Each of lines 46 extends from its anchor point via a respective one of three sheaves 48 mounted to the upper surface of the port support arm adjacent to the collar. Lines 46 then extend rearwardly along the support arm and into the hull to a fixed connection point; it will be appreciated, however, particularly from the following description pertinent to FIG. 7, that the ends of port surge compensation lines 46 remote from the collar may be connected to constant tension mechanisms, if desired. In the case where the opposite ends of the port surge compensation lines are connected to fixed points, i.e., to anchors 47 at the collar and to suitable bollards or the like on the ship, the total length of lines 46, in combination with the spring effect per foot of line, is selected to limit sway motions of hull 26 at the bow thereof, in a direction to starboard relative to pylon 11, to a distance which is less than the normal clearance between sway fenders 35 on the collar and the adjacent fenders 34 on the support arms. Lines 46 are preferably 7 inch diameter braided 2-in-1 nylon hawsers having a total length, between their opposite fixed ends, of about 125 feet. A starboard sway compensation connection 49 includes three starboard compensation lines 50 and is a duplicate of port sway compensation connection 45.

The broken line which appears in FIG. 5 between collar 29 and port sway fender 34 represents the normal limit of movement of the collar relative to the support arms in response to maximum sway motions of the ship relative to pylon 11. The broken lines which appear in FIG. 5 between the collar and starboard sway fender 34 represent the position of the collar relative to the support arms under a side collision force which, as manifested at the location of mooring arrangement 44, has a magnitude of about 1,000,000 lbs.

A pair of forward surge connections 51 are provided to connect collar 29 to the forward ends of support arms 30 forwardly of the normal position of the collar in recess 32. Forward surge connections 51 are identical, and therefore only the surge connection between the collar and starboard support arm 30 is described in detail. A length of 7 inch diameter braided 2-in-1 nylon hawser 52 has one end thereof secured to a dead-end bollard 53 mounted to the upper end of starboard support arm 30. From the bollard, line 52 extends to a swivel block 54 which is pivotally connected to collar 29. Line 52 is reeved between swivel block 54 and a similar swivel block 55 pivoted to the support arm adjacent bollard 53, and ultimately to a constant tension winch 56 which is also mounted to the forward end of support arm 30 adjacent to bollard 53. From winch 56, line 52 passes through an entrance opening 57 to a rope locker defined within the interior of the support arm. Winch 56 preferably is a Samson Ocean Systems, Inc. traction winch; see *Ocean Industry,* page 64 et seq., July 1976. Preferably the normal distance between sheaves 54 and 55 is on the order of 53 feet.

A single aft surge resilient connection 58 is connected between the rear of collar 29 and hull 26 along the longitudinal centerline of the hull. A multi-sheave swivel block 61 is pivotally connected to collar 29. A hawser 59 similar to that defining lines 46, 50 and 52 is reeved between block 61 and a similar multi-sheave swivel block 62 which is pivotally connected to hull 26 adjacent bollard 60, and then to a constant tension winch 63 from which the line passes through an entrance opening 64 to a rope locker within the hull. Line 59 is reeved between bollard 60, blocks 61 and 62 and winch 63 to define a multi-part connection between the hull and collar 29 which is stronger than both of forward surge connections 51. This is in recognition of the fact that hull 26 tends to weathervane downstream of pylon 11 in response to wind, wave and current actions on the hull. Therefore, the hull is normally subjected to some relatively steady-state forces which tend to move it away from the pylon in such a manner as to keep the aft surge connection 58 under tension. Aft surge motions are superimposed on this steady-state load on the aft surge connection.

Preferably the deck of hull 26 to which bollard 60, block 62 and winch 63 are mounted slopes downwardly toward the rear edge of recess 32 in area 64 forward of block 62, thereby to provide clearance for the aft surge connection.

Figure 6:
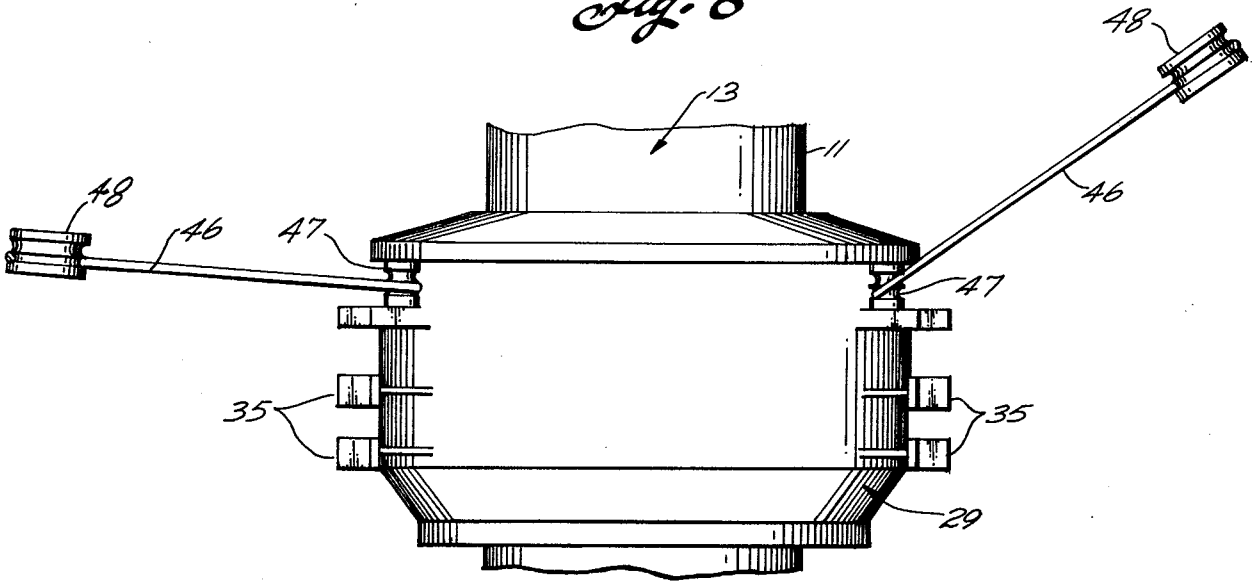
FIG. 6 is a simplified elevation view illustrating certain aspects of the mooring illustrated in FIG. 5 in two conditions of roll of the ship relative to the anchor structure.

FIG. 6 is a transverse elevation view of collar 29 and two of the sway connections of mooring 44. FIG. 6 shows the sway connection in the normal even-keel state of the hull in the left side of FIG. 6, and shows the sway connection on the right side of FIG. 6 when the hull is rolled 10° about its roll axis. FIG. 6, therefore, illustrates that mooring 44 accommodates roll of hull 26 about its roll axis relative to pylon 11 without restricting such roll. On the other hand, surge and sway motions of the hull relative to pylon 11 are damped as the forces which produce such motions of the hull are absorbed in the surge and sway resilient connections. The surge and sway resilient connections also, as described above, limit the surge and sway motions of the vessel relative to the pylon so that, under all normal operating conditions, the collar 29 does not contact fenders 34 carried by the hull.

Figure 7:
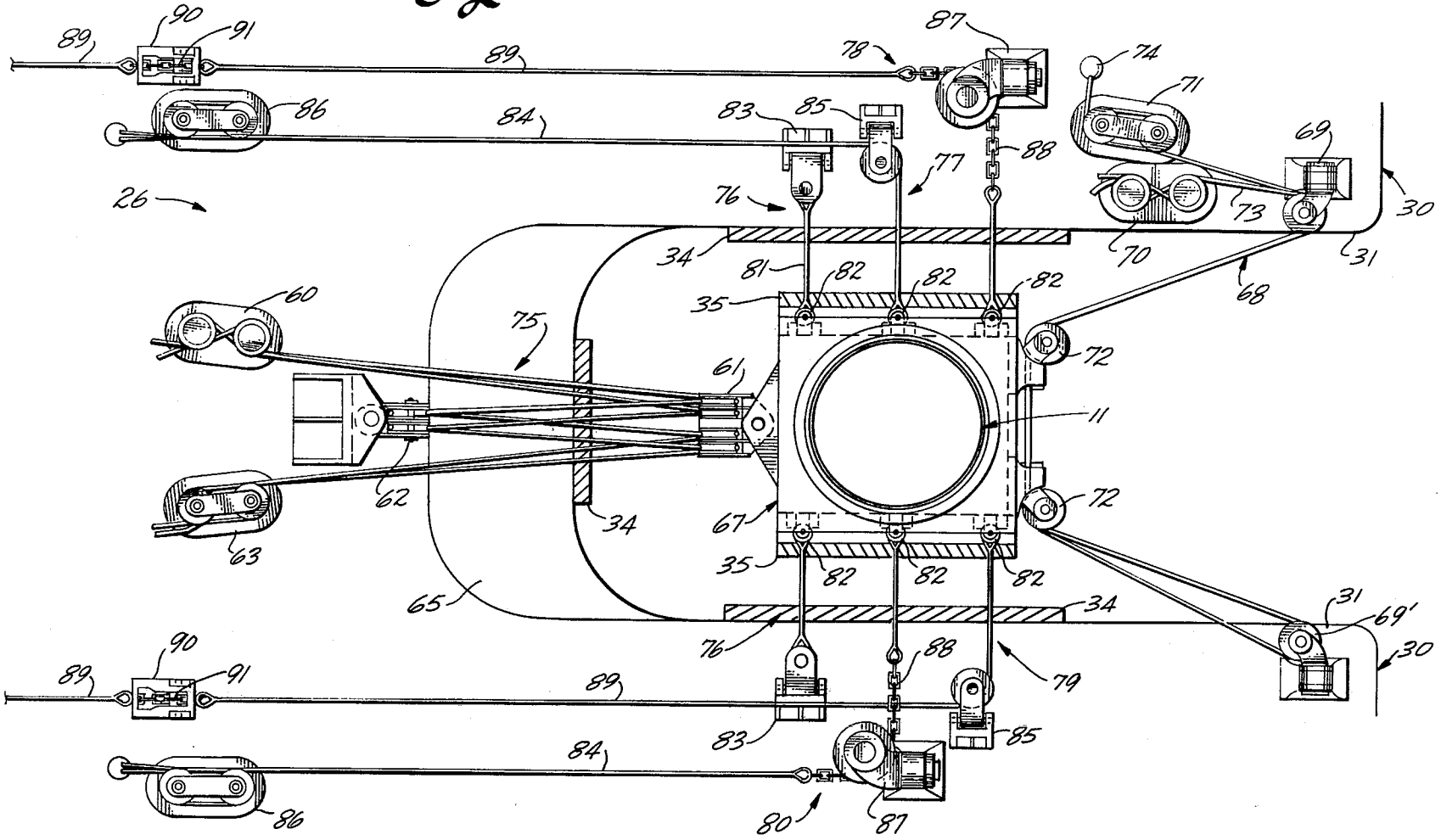
FIG. 7 is a plan view, similar to that of FIG. 5, showing several modifications of the resilient connections.

Mooring 44, shown in FIG. 5, and also the variations of mooring 44 illustrated in FIG. 7, is designed to accommodate vertical travel of the hull at pylon 11 due to pitch, heave, tides, ballasting of the hull and the like over a distance on the order of 92 feet. The mooring is designed to withstand safely a total surge load of 2,000,000 lbs. on pylon 11, and a total sway load on the pylon of 500,000 lbs. Pylon 11 has a diameter of 20 feet. The collar 29 has a weight of approximately 200,000 lbs. A coefficient of friction of 0.25 is assumed. The motions which mooring 10 is designed to withstand include surge motions of ± 10 feet at 14 seconds, roll of ± 10° at 16.7 seconds, pitch of ± 3° at 11.3 seconds, and heave of ± 10 feet at 12 seconds. The design safety factor in this mooring is at least 3.

FIG. 7 is a plan view similar to that of FIG. 5 which shows another collar 67 disposed circumferentially about pylon 11 for rotation about and axial movement along the pylon. The arrangement shown in FIG. 7 is a composite of several different types of resilient connections which may be used in a mooring system according to this invention. Thus, FIG. 7 shows another forward surge connection 68 which may be used in place of the two separate forward surge connections 51 shown in FIG. 5. Forward surge connection 68 includes a double-sheave swivel chock 69 and a single-sheave swivel chock 69'; these chocks are mounted to the upper surfaces of the support arms adjacent their forward ends. A bollard 70 and a constant tension winch 71 are both mounted adjacent to chock 69. Forward surge connection 68 also includes a pair of double-sheave swivel chocks 72 which are mounted to the forward face of collar 67. A hawser 73, preferably a 7 inch 2-in-1 nylon hawser, is secured at one end to bollard 70 and is then reeved through the adjacent double-sheave chock 69, through chocks 72, through chock 69' and then back via chocks 72 and 69 to constant tension winch 71 from which it passes through an opening 74 to a rope locker. The constant tension winch operates to take in and pay out hawser 73 during forward surge motions of the ship relative to pylon 11.

An aft surge connection 75 is similar to aft surge connection 58, shown in FIG. 5 and described above, except that surge connection 75 is a double rope system in which two ropes have their respective ends connected to bollard 69. From the bollard the ropes are reeved through swivel blocks 61 and 62 to constant tension winch 63.

Five separate sway connections 76, 77, 78, 79 and 80 are shown in FIG. 7. In actual practice of this invention, only a single type of sway connection would be used in the mooring. The purpose of FIG. 7 is to illustrate, without undue multiplication of drawings, various types of sway connections which may be used to advantage in a mooring according to this invention. Each sway connection 76–80 is a double connection which, in the plan view of FIG. 7, appears as a single connection; this fact should be borne in mind in reading the following description.

Where sway connections 76 are used, twelve equal length hawsers 81 are installed in pairs between six double anchor points 82 connected three to each of the longitudinal sides of collar 67. Each hawser 81 is fitted with a thimble at each of its opposite ends for cooperation with anchor points 82 and with double anchor chocks 83 which are fixed to the upper surfaces of support arm 30 adjacent the collar. In sway connections 76, hawsers 81 are installed without pretensioning and have an unstretched length of approximately 16 feet.

In sway connection 77, a pair of hawsers, each having an unstretched length of approximately 100 feet, are connected at one end to an anchor point 82 from which they extend via a two-sheave rope mooring chock 85, mounted to the adjacent support arm, to a constant tension winch 86 with which both hawsers 84 are engaged before passage to a rope storage locker. Sway connection 77 is therefore seen to be an active sway connection as opposed to sway connection 76 which is a purely passive connection. Sway connection 77 is active in that hawsers 84 are payed out and taken in by constant tension winch 86 as sway motions are manifested in the mooring, both to accommodate such sway motions and to absorb the forces tending to produce relative movement in a sway direction transversely of the ship at pylon 11.

Sway connection 80 is similar to sway connection 77 in that it is an active sway connection. Sway connection 80 differs from sway connection 77, however, in that two-sheave rope mooring chock 85 is replaced by a two-sheave chain mooring chock 87 which cooperates with respective lengths of chain 88 interposed in hawsers 84 where the hawsers make the turn from constant tension winch 86 to collar 67. Under certain circumstances, chain lengths 88 may be preferred in an active sway connection at the location where the sway lines make the first connection to the ship in extending from the collar to the constant tension winches, thereby to prevent wear of the hawser and thus extend the useful life of the sway connection.

Sway connections 78 and 79, like sway connection 76, are passive. In sway connection 79, a pair of hawsers 89 extend from an anchor point 82 to engagement with two-sheave rope mooring chocks 85 secured to the support arms; from the rope mooring chocks, hawsers 89 extend aft to a pair of chain stops 90, only one of which is shown in association with sway connection 79. In the vicinity of the chain stops, each hawser includes a length of chain 91. The portion of the hawser 89 which extends aft from the chain stop is used to pretension the sway connection to the desired level of preload, at which time chain 91 is secured in the chain stop 90. In this arrangement, a single winch (not shown) on board the ship can be used to pretension all 12 lines in the sway connections.

Sway connections 78 are like sway connections 79 except that the two-sheave rope mooring chocks 85 adjacent the collar anchor points in each sway connection are replaced by double-sheave chain mooring chocks 87.

In all of the passive sway connections illustrated in FIG. 7, it is the spring effect, i.e., the resilient characteristics of the hawsers of the sway connections, which is relied upon to absorb and damp the forces associated with sway motions of the vessel relative to pylon 11. In active sway connections 77 and 80, both the spring effects of the hawsers and the constant tension winches are used for this purpose.

Figure 8:
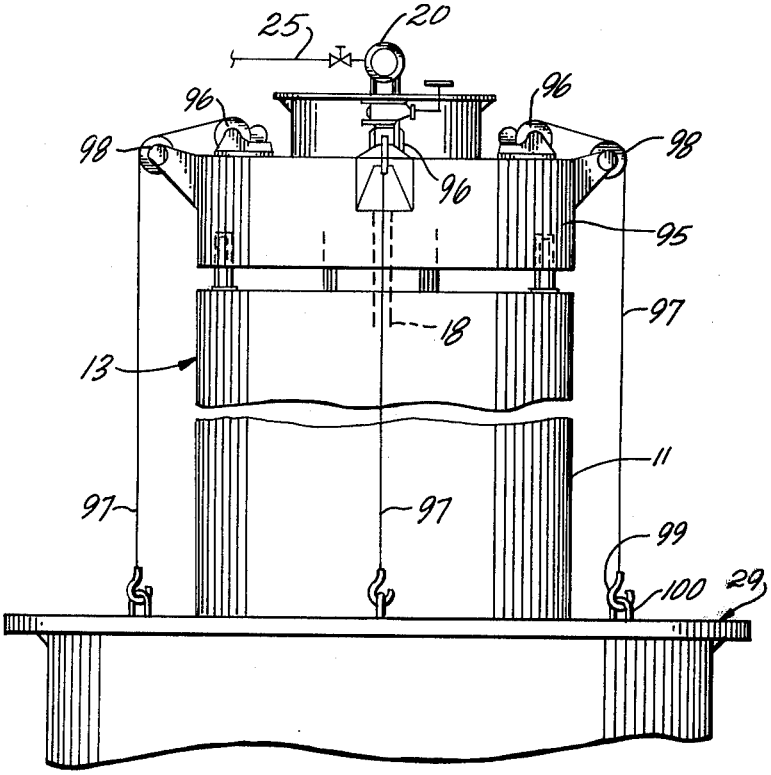
FIG. 8 is a simplified elevation view which shows how the collar on the mooring point is supported either for making the initial connection between the mooring point and the factory ship or during overhaul of the mooring system.

To facilitate initial installation between anchor structure 13 and ship 10 of a mooring according to this invention, the upper end of pylon 11 may carry a swivel head 94 (see FIG. 8) which is mounted by rollers, for example, to the upper end of the pylon for rotation relative to the pylon about the central axis of the pylon. A plurality of winches 96 are mounted to the top of the swivel head. A wire rope line 97 extends from each winch via a guide sheave 98 to a hook 99 which, via a padeye 100, is engaged with the collar. Winches 96 and wire ropes 97 are useful to support collar 29 in the desired position vertically along pylon 11 prior to connection of ship 10 to the anchor structure by a mooring arrangement in accord with this invention. It is also apparent that the arrangement illustrated in FIG. 8 makes it possible to hold the collar in a desired position along pylon 11 during periods of overhaul of the surge and sway connections of the mooring.

Figure 9:
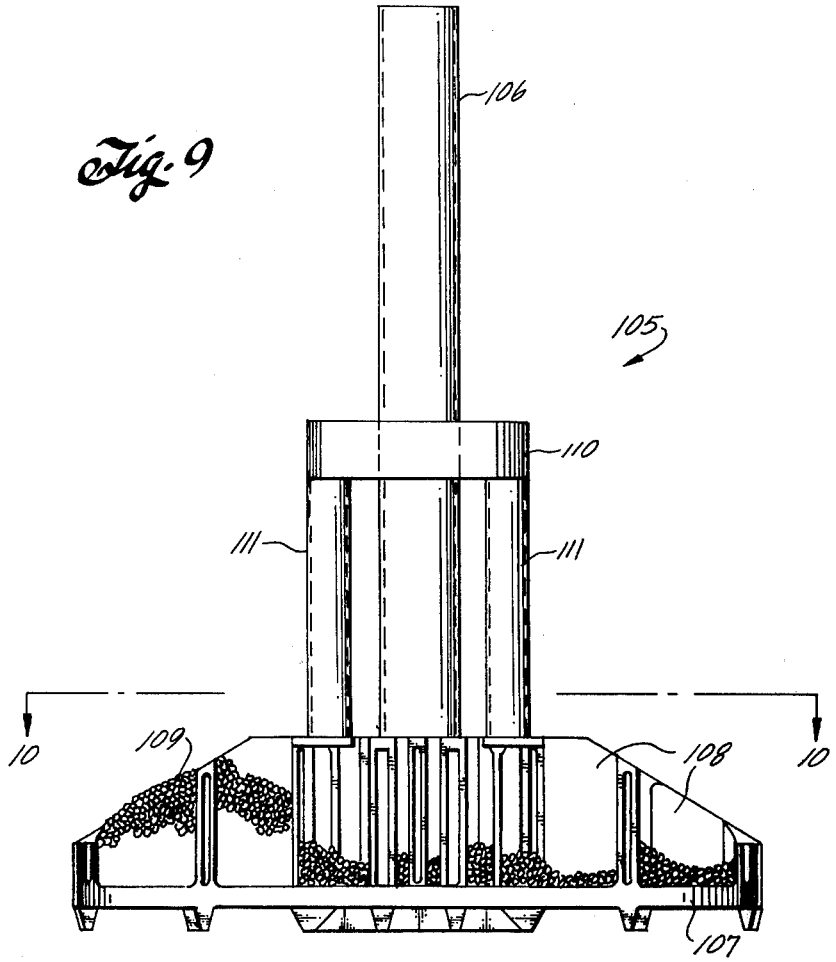
FIG. 9 is a cross-sectional elevation view of another mooring structure according to this invention.
Figure 10:
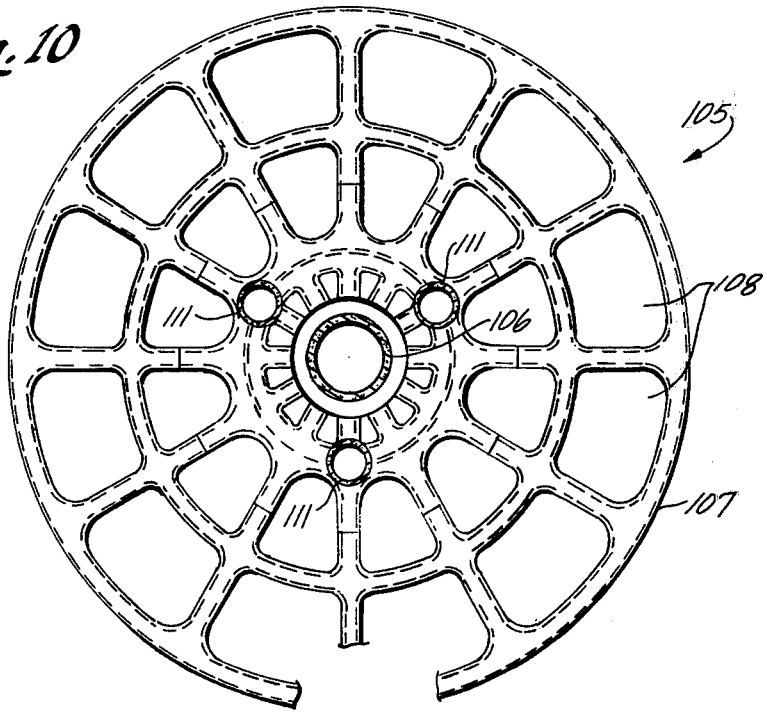
FIG. 10 is a cross-section view taken along line 10—10 in FIG. 9.

It was noted above that anchor structure 13 is intended for use in situations where ship 10 is to be moored in relatively shallow water. In such situations, it is particularly desirable that the anchor structure be sufficiently rigid to prevent application of any cyclic lateral loads to those portions of gas transport pipeline 18 which lie within the anchor structure. In cases where the depth of water in which the vessel to be moored is greater, the extreme rigidity of anchor structure 13 is not essential and a somewhat more flexible anchor structure may be used. A more flexible anchor structure 105 is shown in FIGS. 9 and 10. Anchor structure 105 is also useful where the water is of sufficient depth that it is not convenient to secure the anchor structure to the ocean floor by pilings. Instead, in anchor structure 105, the mass of the structure is relied upon to hold it in place sufficiently securely that its upper portion provides the desired essentially fixed anchor point to which vessel 10 is moored.

Anchor structure 105 includes a central elongate circularly cylindrical pylon 106, the upper end of which defines the mooring point of a mooring arrangement according to this invention. It will be apparent from the preceding description that a suitable swivel assembly is connected to the upper end of the pylon in those mooring installations where it is desired to connect a fluid transport pipeline to the moored ship. Pylon 106 extends from a circular base 107 which defines a plurality of upwardly open cells 108 into which rock ballast, for example, may be introduced to firmly secure the anchor structure in the desired position on the ocean floor after initial placement. At a location elevated above base 107, the pylon carries a collar 110 integral therewith, the collar further being connected to the base by three hollow columns 111. Collar 110 and columns 111 serve to stiffen the pylon relative to base 107. Preferably anchor structure 105 is constructed of reinforced concrete and may have an overall diameter across its base on the order of 300 feet, and an overall height of about 380 feet. Such an anchor structure is useful in water depths of approximately 300 feet.

Persons skilled in the art to which this invention pertains will recognize that the present invention has been described above with reference to a presently preferred mooring arrangement and with reference to alternate mooring arrangements. Such persons will recognize that these embodiments of this invention are but a few of the forms which this invention may take, and that modifications, alterations or variations in the structural arrangements and procedures described above may be practiced without departing from the scope of this invention. Thus, support arms 30 could be located at or under the water surface if, for a particular set of circumstances, such a modification of the arrangements described above would be a technical advantage. The collar 29 could be made buoyant if located at the water surface, and a closure could be provided between the forward ends of the arms to mitigate wave action on the collar. Also, the resilient connections between the moored structure and the mooring collar could be defined by metal springs, elastomeric springs, gas-oil springs, counterweights, or hydraulic absorbers, for example, rather than the presently preferred lines and hawsers. Accordingly, the preceding description should not be construed as limiting or restricting the following claims only to the specific structural arrangements and procedures which have been described.

What is claimed is:

1. Apparatus for mooring a structure floating in a body of water to an anchor point located above the water surface, comprising a substantially rigid anchor structure fixed to the bottom of the body of water and extending above the water surface where it defines a right circular cylinder having a vertically disposed axis, the portion of the structure above the water surface comprising said anchor point, a collar mounted to the cylinder circumferentially thereof for motion angularly about and axially along the cylinder, a pair of rigid supports extending from the floating structure, the supports being spaced substantially equally from and on opposite sides of a roll axis of the floating structure, the spacing between the supports being greater than the diameter of the collar, and resilient connections between the supports and the collar (a) for locating the collar centrally between the supports in a normal state of the mooring apparatus, (b) for affording and accommodating motions of the floating structure, as manifested at the supports, relative to the collar in horizontal linear directions and angularly about the roll axis in surge, sway and roll, and (c) for absorbing the forces manifested between the collar and the floating structure in association with the surge and sway motions, the collar moving on the anchor structure cylinder in response to pitch, heave and heading change motions of the floating structure.

2. Apparatus according to claim 1 wherein the floating structure is of substantially shipform configuration, and the supports extend forwardly from the bow thereof.

3. Apparatus according to claim 1 wherein the supports and the resilient connections are cooperatively defined to enable the floating structure to be floated away from the anchor structure upon uncoupling of the resilient connections.

4. Apparatus according to claim 1 wherein the resilient connections include separate resilient connections for absorbing the forces associated with (a) sway motions in one sway direction, (b) sway motions in the opposite sway direction, (c) surge motions in one surge direction, and (d) surge motions in the opposite surge direction.

5. Apparatus according to claim 4 wherein each sway motion resilient connection comprises a plurality of independent resilient connections.

6. Apparatus according to claim 4 wherein one of the surge motion resilient connections comprises plural resilient connections from the collar to the supports.

7. Apparatus according to claim 4 wherein one of the surge motion connections is substantially stronger than the other surge motion connection.

8. Apparatus according to claim 7 wherein the one surge motion connection is stressed in tension in response to motion of the floating structure away from the anchor point.

9. Apparatus according to claim 4 wherein each resilient connection includes at least one length of hawser as distinguished from chain and from cable and wire rope.

10. Apparatus according to claim 9 wherein each sway motion connection comprises a plurality of hawsers each connected at one end to an anchor point on the collar and connected at its opposite end to an anchor point on the support proximate the collar.

11. Apparatus according to claim 9 wherein each sway motion connection comprises a plurality of lines each connected at one end to an anchor point on the collar and extending to its opposite end via a sheave mounted on the corresponding support proximately adjacent the collar.

12. Apparatus according to claim 11 wherein, in each sway motion connection, the line extends for a substantial distance parallel to the roll axis between the sheave and its opposite end.

13. Apparatus according to claim 12 wherein, in each sway motion connection, the line is defined only by a hawser.

14. Apparatus according to claim 13 wherein the opposite end of each line is connected to a constant tension device.

15. Apparatus according to claim 12 wherein, in each sway motion connection, the line is defined principally by a hawser and includes, in the extent thereof at and adjacent the sheave, a length of chain, the sheave being a chain sheave.

16. Apparatus according to claim 15 wherein the opposite end of each line is connected to a constant tension device.

17. Apparatus according to claim 15 wherein the opposite end of each line is fixedly connected to the floating structure.

18. Apparatus according to claim 17 wherein each line, at and adjacent the location of its fixed connection to the floating structure, includes a second length of chain, and a chain stop for each line secured to the floating structure and engaged with the second length of chain.

19. Apparatus according to claim 9 wherein the one surge direction is a forward surge direction, and the resilient connection for the forward surge direction is defined by separate and independent multi-part hawser connections from the collar to each support at a location on the support forward of the collar.

20. Apparatus according to claim 9 wherein the one surge direction is a forward surge direction, and the resilient connection therefor is defined by a hawser connected between the supports forward of the collar via the collar.

21. Apparatus according to claim 20 including a constant tension device to which one end of the hawser is connected.

22. Apparatus according to claim 9 wherein the connections for the two surge directions each include a constant tension device to which the hawser of said connection is connected.

23. Apparatus according to claim 4 wherein the surge and sway motion resilient connections provide the support for the collar along the cylinder.

24. Apparatus according to claim 1 including means carried by the anchor structure and releasably engageable with the collar for supporting the collar on the cylinder.

25. A method of mooring a floating vessel having a ship-like hull configuration to an essentially fixed single-point anchor structure located above the water surface comprising securing to the bottom of a body of water in which the vessel is to be moored a substantially rigid anchor structure which, as secured, extends above the water surface and defines above the water surface a cylinder having a vertical axis, disposing around the cylinder a collar which is movable both angularly about and axially along the cylinder, providing on the vessel at the bow-end on opposite sides of the roll axis thereof a pair of rigid supports which are spaced from each other a distance greater than the diameter of the collar so that, when the collar is disposed centrally between the supports, a clearance exists between the collar, the supports and the vessel, and establishing between the collar and the vessel, considered as the vessel per se and the supports, a plurality of resilient connections in both directions along lines transversely of the vessel and effectively parallel to the roll axis of the vessel in such manner as to support the collar from the vessel along the cylinder, to accommodate rolling motion of the vessel relative to the collar, and to both accommodate and absorb the forces of sway and surge motions of the vessel relative to the collar, and also to transmit to the collar for accommodation by relative motion between the collar and the cylinder vessel motions due to heave, pitch and heading change of the vessel relative to and about the anchor structure.

26. A method according to claim 25 including defining the resilient connections principally by hawsers.

27. A method according to claim 25 including establishing a predetermined load in at least some of the resilient connections.

28. A method according to claim 27 wherein the predetermined load is a tension load.

* * * * *